US006271192B1

(12) United States Patent
Verstrat et al.

(10) Patent No.: US 6,271,192 B1
(45) Date of Patent: Aug. 7, 2001

(54) ASSOCIATIVE THICKENER FOR AQUEOUS FABRIC SOFTENER

(75) Inventors: Daniel W. Verstrat, Ooltewah; Joseph S. Maxim, Jr., Chattanooga, both of TN (US); James Rosie, Milton Keynes (GB)

(73) Assignee: National Starch and Chemical Investment Holding Company, Wilmington, DE (US)

( * ) Notice: Subject to any disclaimer, the term of this patent is extended or adjusted under 35 U.S.C. 154(b) by 0 days.

(21) Appl. No.: 09/437,819

(22) Filed: Nov. 10, 1999

(51) Int. Cl.[7] ..... C11D 3/37
(52) U.S. Cl. ..... 510/527; 510/476; 510/522
(58) Field of Search ..... 526/301; 510/476, 510/522, 527

(56) References Cited

U.S. PATENT DOCUMENTS

| | | | | |
|---|---|---|---|---|
| 5,011,978 | * | 4/1991 | Barron et al. | 560/221 |
| 5,114,600 | | 5/1992 | Biggin | 252/86 |
| 5,294,692 | * | 3/1994 | Barron et al. | 526/301 |
| 5,639,841 | * | 6/1997 | Jenkins | 526/333 |
| 5,869,442 | | 2/1999 | Srinivas | 510/476 |

FOREIGN PATENT DOCUMENTS

WO 99/06455 11/1999 (WO) .

OTHER PUBLICATIONS

Matthew I. Levinson "Rinse–Added Fabric Softener Technology at the Close of the Twentieth Century", Journal of Surfactants and Detergents, vol. 2, No. 2 (April 1999), pp. 223–230.

* cited by examiner

*Primary Examiner*—John Hardee
(74) *Attorney, Agent, or Firm*—Thomas F. Roland

(57) ABSTRACT

A thickened aqueous fabric softener composition comprising at least one surfactant and a polymeric rheology modifier, wherein said polymeric rheology modifier is the polymerization product of (i) an alkyl ester of acrylic acid or methacrylic acid; (ii) a monomer selected from the group consisting of a vinyl-substituted heterocyclic compound containing at least one nitrogen or sulfur atom, (meth) acrylamide, a mono- or di-alkylamino alkyl(meth)acrylate, and a mono or di-alkylamino alkyl(meth)acrylamide; and (iii) an associative monomer. The polymeric rheology modifier does not require a make down step to slurry or disperse it into a fabric softener composition. The thickened fabric softener compositions do not affect rewettability, nor do they build up on cloth in multi-cycle washing. In addition, the thickened fabric softener compositions provide softening and reduce the formation of wrinkles.

12 Claims, No Drawings

ASSOCIATIVE THICKENER FOR AQUEOUS FABRIC SOFTENER

FIELD OF THE INVENTION

This invention relates to an aqueous thickened fabric softener composition containing at least one surfactant and a polymeric rheology modifier which is prepared by polymerizing an alkyl ester of acrylic acid or an alkyl ester of methacrylic acid; a nitrogen or sulfur containing monomer; and an associative monomer.

BACKGROUND OF THE INVENTION

Fabric softeners provide a means to impart a variety of desirable characteristics to clothing, the most obvious being improved feel when the fabric is rubbed across the skin. Through the use of perfume or masking scents, fabric softeners can also impart a perception of freshness. In addition, fabric softeners provide a delivery vehicle for attaching other consumer-beneficial additives, such as soil release agents, whitening agents, antiwrinkling agents, dye transfer inhibition agents, color protection agents, and fabric care agents.

The history of fabric softeners in consumer use is associated with the conversion of laundry detergents from tallow-based soaps to synthetic bases. Since ancient times, clothes have been washed with soaps (sodium salts of fatty acids) by hand, and later with a mechanical washing machine. Around 1945, synthetic detergents, primarily based on alkylbenzenesulfonates as well as other secondary surfactants began to rise in prominence for machine washing in North America. The new generation of laundry detergents was formulated with builders, that is, sequestering agents such as phosphate, carbonate or citrate, to reduce the deposition of insoluble calcium and magnesium salts of soap and alkylbenzenesulfonates. These insoluble calcium and magnesium salts cause redeposition of soil, resulting in a gradual buildup of a dingy, gray film on light-colored fabrics.

The presence of sequestering agents resulted in a significant reduction in the amount of lime soaps left behind on clothes. Moreover, mechanical washing machines coupled with improved detergent formulations led to improved removal of oils, clay soils, and other natural fiber lubricants. These residues all contributed to a softer hand and their enhanced removal resulted in a harsher feel of the fabric.

Cotton, still the predominant fiber in today's textile industry, suffers from unique mechanical wear and tear processes which ultimately create consumer demand for fabric softeners. With repeated laundering, cotton microfibrils break and unravel. Mechanical friction in the washing process induces static charges that cause the microfibrils to project orthogonally from the fiber bundle upon drying. These microfibrils act as barbs which inhibit fiber-fiber slippage, interfere with fiber flexibility, and are perceived as a sources of a drag when drawn across the skin. All of these phenomena contribute to the total perception of roughness. Softening materials can reduce fiber-fiber interactions by reducing static and allowing microfibrils to lay parallel to the fiber bundle and/or by coating and lubricating the fiber bundle to minimize friction. Further, they can provide a lubricating layer between the fiber surface and human skin. The net result is the perception of a less abrasive, more pliable fabric.

Cationic surfactants are the most common ingredients used worldwide as rinse-added fabric softeners. The reasons for this are many. They are cost-effective, being highly efficient at depositing or "exhausting" onto the fabric even at extremely low concentrations. They are effective at reducing microfibril static and interfiber friction. They provide a renewable finish that interferes only minimally with the laundering process. They are is based on low-cost raw materials, predominantly tallow, lard, or alternatively, on seed oils such as palm oil, soybean, or canola (rapeseed) oil. They are relatively easy to formulate with conventional mixing equipment and require few supplemental ingredients. They are essentially nontoxic to higher life forms. They are ultimately biodegradable and do not build up in the environment.

It is well known that controlling the rheology and physical stability of cationic softener formulations is difficult. This is due to the fact that cationic surfactants are disrupted and rendered ineffective by a wide range of materials. Anionic species, either dissolved or suspended may adsorb or precipitate the surfactant, causing both rheological and physical instability i.e. the product may become too thick or too thin, or phase separation of the aqueous phase may occur. Thus, unless used to form neutral fatty softening species or to deliberately thin the formulation e.g. liquid concentrates, anionic surfactants and additives are avoided by the industry. The formulations cannot therefore be thickened using anionic polymer thickeners.

Many current fabric softener compositions use heteropolysaccharides such as xanthan gums as rheology modifiers. The xanthan gums are dry materials and therefore require a make down step to slurry or disperse the material into the fabric softener composition. In addition, xanthan gums are a source for microbial growth. Microbial contamination causes a loss of viscosity in the fabric softener composition and subsequent spoilage of the product.

U.S. Pat. No. 5,114,600 describes a fabric conditioning formulation containing a cationic softener and a cross-linked cationic polymer which is prepared from an ethylenically unsaturated monomer which is crosslinked with 5 to 45 ppm of a cross-linking agent. U.S. Pat. No. 5,869,442 describes a fabric softening composition containing a polyvinylpyridine betaine containing a quaternary nitrogen and a carboxylate salt. PCT application WO 99/06455 describes crosslinked cationic homopolymers as thickening agents for acidic laundry softeners. The crosslinking agent is present in an amount of from not less than 50 to 600 ppm of the homopolymer total weight.

There continues to be a need for controlling the rheology and physical stability of cationic softener formulations without a make down or slurry step prior to dispersing the rheology modifier in the fabric softener.

SUMMARY OF THE INVENTION

The present invention provides an aqueous thickened fabric softener composition comprising at least one surfactant and a polymeric rheology modifier, wherein said polymeric rheology modifier is the polymerization product of (i) 5 to 80 weight percent of an alkyl ester of acrylic acid or an alkyl ester of methacrylic acid, wherein the alkyl group has 1 to 18 carbon atoms;

(ii) 5 to 80 weight percent of a monomer selected from the group consisting of a vinyl-substituted heterocyclic compound containing at least one nitrogen or sulfur atom, (meth)acrylamide, a mono- or di-alkylamino alkyl(meth)acrylate, and a mono or di-alkylamino alkyl (meth)acrylamide, wherein the alkyl group has 1 to 4 carbon atoms; and 0.1 to 30 weight percent of an associative monomer selected from the group consisting of (a) urethane reaction products of a monoethylenically unsaturated isocyanate and non-ionic surfactants comprising $C_1$–$C_4$ alkoxy-terminated, block copolymers of 1,2-butylene oxide and 1,2-ethylene oxide; (b) an ethylenically unsaturated copolymerizable surfactant monomer obtained by condensing a nonionic surfactant with an ethylenically unsaturated carboxylic acid or the anhydride thereof; (c) a surfactant monomer selected from the group consisting of urea reaction product of a monoethylenically unsaturated monoisocyanate with a nonionic surfactant having amine functionality; (d) an allyl ether of the formula $CH_2{=}CR'CH_2OA_mB_nA_pR$ wherein R' is hydrogen or methyl, A is propyleneoxy or butyleneoxy, B is ethyleneoxy, n is zero or an integer, m and p are zero or an integer less than n, and R is a hydrophobic group of at least 8 carbon atoms; and (e) a nonionic urethane monomer which is the urethane reaction product of a monohydric nonionic surfactant with a monoethylenically unsaturated isocyanate; and (iv) 0 to 1 weight percent of a cross-linking monomer having at least two ethylenically unsaturated moieties wherein the weight percent of monomers is based on 100 weight percent.

The polymeric rheology modifier of the invention does not require a make down step to slurry or disperse it into a fabric softener composition. Moreover, the polymeric rheology modifier provides an increase in viscosity and stability to a fabric softener. The increase in stability is especially important in fabric softeners which have a tendency to phase separate while being stored due to the high concentration of cationic surfactants in water.

The thickened fabric softener compositions of the invention reduce the drying time of fabrics and extend the life of fabrics by reducing interfiber friction and mechanically induced fiber damage during the tumble-drying process. In addition, the thickened fabric softener compositions do not affect rewettability, nor do they build up on cloth in multicycle washing as compared to a fabric softener composition without a polymeric rheology modifier. Furthermore, the thickened fabric softener compositions provide softening and reduce the formation of wrinkles equivalent to fabric softener compositions which were not thickened according to the invention.

DESCRIPTION OF THE INVENTION

The thickened fabric softener compositions of the invention comprise a thickening agent which is a polymeric rheology modifier and at least one surfactant. The polymeric rheology modifier is prepared by polymerizing (i) an alkyl ester of acrylic acid or an alkyl ester of methacrylic acid, wherein the alkyl group has 1 to 18 carbon atoms; (ii) a monomer selected from the group consisting of a vinyl-substituted heterocyclic compound containing at least one nitrogen or sulfur atom, (meth)acrylamide, a mono- or di-alkylamino alkyl(meth)acrylate, and a mono or di-alkylamino alkyl(meth)acrylamide, wherein the alkyl group has 1 to 4 carbon atoms; (iii) an associative monomer; and optionally (iv) a cross-linking monomer having at least two ethylenically unsaturated moieties.

The alkyl ester of acrylic acid or methacrylic acid (i) are prepared from acrylic acid or methacrylic acid and an alcohol having 1 to 18 carbon atoms. Suitable alcohols include ethanol, butanol, hexanol, propanol, dodecanol, and stearyl alcohol. A preferred alkyl ester of acrylic acid is ethyl acrylate. The amount of the alkyl ester of acrylic acid or methacrylic acid that is used to prepare the polymeric rheology modifier is from 5 to 80 weight percent, preferably from 15 to 70 weight percent, and more preferably from 40 to 70 weight percent, wherein the weight percents are based on the total weight of monomer used to prepare the polymeric rheology modifier.

The polymeric rheology modifier is also prepared with a monomer (ii) which is selected from the group consisting of a vinyl-substituted heterocyclic compound containing at least one nitrogen or sulfur atom, (meth)acrylamide, a mono- or di-alkylamino alkyl(meth)acrylate, and a mono or di-alkylamino alkyl(meth)acrylamide, wherein the alkyl group has 1 to 4 carbon atoms. Suitable monomers include N,N-dimethylamino ethyl methacrylate (DMAEMA), N,N-diethylamino ethyl acrylate, N,N-diethylamino ethyl methacrylate, N-t-butylamino ethyl acrylate, N-t-butylamino ethyl methacrylate, N,N-dimethylamino propyl acrylamide, N,N-dimethylamino propyl methacrylamide, N,N-diethylamino propyl acrylamide and N,N-diethylamino propyl methacrylamide. The amount of monomer (ii) that is used to prepare the polymeric rheology modifier is from 5 to 80 weight percent, preferably from 10 to 70 weight percent, and more preferably from 20 to 60 weight percent, wherein the weight percents are based on the total weight of monomer used to prepare the polymeric rheology modifier.

The polymeric rheology modifier is also prepared with an associative monomer (iii). The associative monomer is selected from (a) urethane reaction products of a monoethylenically unsaturated isocyanate and non-ionic surfactants comprising $C_1$–$C_4$ alkoxy-terminated, block copolymers of 1,2-butylene oxide and 1,2-ethylene oxide, which are described in U.S. Pat. No. 5,294,692; (b) an ethylenically unsaturated copolymerizable surfactant monomer obtained by condensing a nonionic surfactant with an ethylenically unsaturated carboxylic acid or the anhydride thereof, preferably a $C_3$–$C_4$ mono- or di-carboxylic acid or the anhydride thereof, more preferably a carboxylic acid or the anhydride thereof selected from acrylic acid, methacrylic acid, crotonic acid, maleic acid, maleic anhydride, itaconic acid and itaconic anhydride, as described in U.S. Pat. No. 4,616,074; (c) a surfactant monomer selected from the group consisting of urea reaction product of a monoethylenically unsaturated monoisocyanate with a nonionic surfactant having amine functionality, as described in U.S. Pat. No. 5,011,978; (d) an allyl ether of the formula $CH_2{=}CR'CH_2OA_mB_nA_pR$ wherein R' is hydrogen or methyl, A is propyleneoxy or butyleneoxy, B is ethyleneoxy, n is zero or an integer, m and p are zero or an integer less than n, and R is a hydrophobic group of at least 8 carbon atoms; and (e) a nonionic urethane monomer which is the urethane reaction product of a monohydric nonionic surfactant with a monoethylenically unsaturated isocyanate, preferably a monomer lacking ester groups such as alpha, alpha-dimethyl-m-iso-propenyl benzyl isocyanate, as described in U.S. Pat. Re. 33,156.

Particularly preferred associative monomers are the ethylenically unsaturated copolymerizable surfactant monomers obtained by condensing a nonionic surfactant with itaconic acid. The amount of the associative monomer (iii) that is used to prepare the polymeric rheology modifier is from 0.1 to 30 weight percent, preferably from 1 to 20 weight percent, and more preferably from 2 to 10 weight percent, wherein the weight percents are based on the total weight of monomer used to prepare the polymeric rheology modifier.

The polymeric rheology modifier is optionally prepared with a cross-linking monomer (iv) having at least two ethylenically unsaturated moieties. Suitable cross-linking monomers include multi-vinyl-substituted aromatic monomers, multi-vinyl-substituted alicyclic monomers, di-functional esters of phthalic acid, di-functional esters of methacrylic acid, multi-functional esters of acrylic acid, N,N'-methylene-bisacrylamide and multi-vinyl-substituted aliphatic monomers such as dienes, trienes, and tetraenes. Preferred cross-linking monomers are divinylbenzene, trivinylbenzene, 1,2,4-trivinylcyclohexane, 1,5-hexadiene, 1,5,9-decatriene, 1,9-decadiene, 1,5-heptadiene, di-allyl phthalate, ethylene glycol dimethacrylate, polyethylene glycol dimethacrylate, penta- and tetra-acrylates, triallyl pentaerythritol, octaallyl sucrose, cycloparrafins, and cycloolefins. A preferred cross-linking monomer is di-allyl phthalate.

If applicable, the amount of the crosslinking monomer (iv) that is used to prepare the polymeric rheology modifier is from 0.01 to 1 weight percent, preferably from 0.01 to 0.5 weight percent, and more preferably from 0.1 to 0.3 weight percent, wherein the weight percents are based on the total weight of monomer used to prepare the polymeric rheology modifier.

The polymeric rheology modifier may be prepared by methods known in the art such as solution polymerization, emulsion polymerization, inverse emulsion polymerization, etc. In a preferred embodiment, the polymeric rheology modifiers are prepared by forming an emulsion utilizing single-stage emulsion polymerization techniques. The monomers, water, free-radical initiator, surfactant in amounts effective to disperse the polymer in the water upon polymerization of the monomers, and from about 0.5 to about 20 weight percent, based on total weight of the emulsion, of an alcohol selected from the group consisting of a $C_2$–$C_{12}$ linear or branched monohydric alcohol and a non-polymeric polyhydric alcohol, such as ethylene glycol, propylene glycol and glycerol, are combined in a polymerization reactor and maintained at a desired temperature and for a period of time which are effective to polymerize the monomers. Preferably the polymerization reaction is initiated at about 30° C., with the contents of the polymerization vessel attaining a temperature of about 60° C. Typically the reaction time is from about I to about 6 hours.

The amount of polymeric rheology modifier required to effectively thicken the fabric softener composition will depend upon the particular polymer and particular fabric softener composition. Preferably, the fabric softener composition will contain from about 0.01 to about 40 weight percent of the polymeric rheology modifier, based on the total weight of the fabric softener composition. More preferably, the fabric softener composition will contain from 0.1 to 25 weight percent, most preferably 0.5 to 10 weight percent, of the polymeric rheology modifier.

The fabric softener compositions contain at least one cationic surfactant. Optionally, the fabric softener compositions may contain a co-surfactant. Suitable co-surfactants are selected from nonionic, anionic, amphoteric, zwitterionic and semi-polar surfactants. A combination of cationic surfactants and co-surfactants may also be used. Preferably, the fabric softener compositions are prepared with either cationic surfactants or a combination of cationic and nonionic surfactants.

Cationic surfactants include, for example, dieicosyldimethyl ammonium chloride; didocosyldimethyl ammonium chloride; dioctadecyidimethyl ammonium chloride; dioctadecyldimethyl ammonium methosulphate; ditetradecyldimethyl ammonium chloride and naturally occurring mixtures of above fatty groups, e.g. di(hydrogenated tallow) dimethyl ammonium chloride; di(hydrogenated tallow) dimethyl ammonium methosulphate; ditallow dimethyl ammonium chloride; and dioleyidimethyl ammonium chloride. Di(hydrogenated tallow) dimethyl ammonium chloride or dioctadecyl dimethyl ammonium chloride are preferred cationic surfactants.

Cationic surfactants also include imidazolinium compounds, for example, 1-methyl-1-(tallowylamido-) ethyl-2-tallowyl4,5-dihydroimidazolinium methosulphate and 1-methyl-1-(palmitoylamido)ethyl-2-octadecyl 4,5-dihydro-imidazolinium methosulphate. Other useful imidazolinium materials are 2-heptadecyl-1-methyl-1(2-stearoylamido)-ethyl-imidazolinium methosulphate and 2-lauryl-lhydroxyethyl-1-oleyl-imidazolinium chloride.

Anionic surfactants include, for example, from $C_8$ to $C_{20}$ alkylbenzenesulfonates, from $C_8$ to $C_{20}$ alkanesulfonates, from $C_8$ to $C_{20}$ alkylsulfates, from $C_8$ to $C_{20}$ alkylsulfosuccinates or from $C_8$ to $C_{20}$ sulfated ethoxylated alkanols.

Nonionic surfactants include, for example, from $C_6$ to $C_{12}$ alkylphenol ethoxylates, from $C_8$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. Another modification consists of reacting the free OH groups of the polyalkylene oxides with isocyanates. The nonionic surfactants also include $C_4$ to $C_{18}$ alkyl glucosides as well as the alkoxylated products obtainable therefrom by alkoxylation, particularly those obtainable by reaction of alkyl glucosides with ethylene oxide.

Amphoteric surfactants contain both acidic and basic hydrophilic groups. Amphoteric surfactants are preferably derivatives of secondary and tertiary amines, derivatives of quaternary ammonium, quaternary phosphonium or tertiary sulfonium compounds. The cationic atom in the quaternary compound can be part of a heterocyclic ring. The amphoteric surfactant preferably contains at least one aliphatic group, containing about 3 to about 18 carbon atoms.

At least one surfactant is present in the thickened fabric softener composition in an amount of from about 0.1 to about 30 weight percent, preferably from 0.5 to 10 weight percent, more preferably from 1 to 5 weight percent, based on the total weight of the thickened fabric softener composition.

In a preferred embodiment, the pH of the thickened fabric softener composition is maintained at a value from 1.5 to 5, preferably from 2 to 4.

The thickened fabric softener compositions can be made by direct addition of the polymeric rheology modifier to an aqueous based fabric softener composition containing at least one cationic surfactant and optional cosurfactants. Preferably, the thickened fabric softener composition is made by addition of a cationic surfactant in water containing other ingredients to an aqueous dispersion of the polymeric rheology modifier, or most preferably, by dispersing the polymeric rheology modifier in a molten pre-mix made up of a cationic surfactant alone or combined with the other surfactants, and then dispersing the pre-mix into the aqueous seat which may also contain other ingredients.

The following nonlimiting examples illustrate further aspects of the invention.

EXAMPLE 1

Preparation of Polymeric Rheology Modifier I Having 20% Solids.

| Ingredient | Function | Weight (grams) |
|---|---|---|
| A. deionized water | continuous phase | 452 |
| B. *SYNPERONIC A-50 | surfactant | 4.68 |
| C. cetyl 20 EO itaconate | associative monomer | 6.9 |
| D. ethyl acrylate | comonomer | 79 |
| E. **AGEFLEX FM-1 | comonomer | 52.6 |
| F. diallylphthalate | crosslinker | 0.069 |
| G. isopropanol | moderator | 8.2 |
| H. deionized water | diluent | 35.4 |
| I. sodium persulfate | initiator | 0.83 |
| J. deionized water | diluent | 21.5 |
| K. sodium bisulfite (41%) | initiator | 2.5 |
| L. deionized water | diluent | 8.29 |
| M. sodium persulfate | scavenger | 0.51 |

*SYNPERONIC A-50 is an alcohol ethoxylate surfactant and is a trademark of ICI.
**AGEFLEX FM-1 is N'N-dimethylaminoethyl methacrylate and is a trademark of Ciba Specialties.

The ingredients were combined as follows. Ingredients A and B were added to a 1 liter round bottom flask reactor fitted with an agitator, condenser, thermometer, and two 50 ml addition funnels. The reactor contents were heated to 70° C. Ingredients C, D, E, F, and G were premixed and added to the reactor with mixing to form an emulsion. Ingredients H and I were combined as an initiator solution and charged to one of the addition funnels. Ingredients J and K were combined as an initiator solution and charged to one of the addition funnels. Initiator solutions Hi and JK were slowly added to the reactor over 2 hours while the reactor contents were maintained at 70° C. After the slow additions were completed, the reactor was heated to 80° C. for 1 hour. The reactor contents were cooled to 25° C.

EXAMPLE 2

Preparation of Polymeric Rheology Modifier II Having 20% Solids.

The procedure and ingredients according to Example 1 were used to prepare Polymeric Rheology Modifier II, except that Ingredient F (diallylphthalate) was removed.

EXAMPLE 3

Preparation of Polymeric Rheology Modifier III Having 25% Solids.

The procedure and ingredients according to Example 1 were used to prepare Polymeric Rheology Modifier III except that Ingredient F (diallylphthalate) was removed and a corresponding amount of water was removed to bring the weight percent solids to 25%.

EXAMPLE 4

Preparation of Polymeric Rheology Modifier IV Having 20% Solids.

The procedure and ingredients according to Example 1 were used to prepare Polymeric Rheology Modifier IV, except that Ingredient C (cetyl 20 EO itaconate) was replaced with behenyl 25 EO itaconate.

EXAMPLE 5

Preparation of Polymeric Rheology Modifier V Having 20% Solids.

The procedure and ingredients according to Example 1 were used to prepare Polymeric Rheology Modifier V, except that Ingredient C (cetyl 20 EO itaconate) was replaced with stearyl 40 EO itaconate.

EXAMPLE 6

Preparation of Polymeric Rheology Modifier VI Having 20% Solids.

The procedure and ingredients according to Example 1 were used to prepare Polymeric Rheology Modifier VI, except that Ingredient C (cetyl 20 EO itaconate) was replaced with stearyl 40 EO methacrylate.

EXAMPLE 7

Preparation of Cationic Surfactant Emulsion.

A surfactant emulsion was prepared at 3.5% active STEPANEX VR90, which is dialkyl ammonium methoxy sulfate (90% active in isopropanol) available from Stepan, by predispersing in deionized water, with mixing at about 200 rpm at a temperature of 65° C. This was followed by high shear emulsification for 10 minutes on a "Silverson" mixer at a mixing speed of about 4,000to 5,000 rpm. The resulting emulsion was white and had a particle size of 3–10 microns spread, $d_{50}$ 3.4 microns as measured on Malvern Mastersizer X. The emulsion was determined to have a pH of 2.45.

EXAMPLE 8

Preparation of Cationic/nonionic Surfactant Emulsion.

A surfactant emulsion was prepared with 19.4 g (3.5% active) of STEPANEX VR90, which is dialkyl ammonium methoxy sulfate (90% active in isopropanol) available from Stepan, 10 g of SYNPERONIC A7 which is a 7 mole alcohol ethoxylate nonionic surfactant available from ICI, by predispersing in 470.6 g of deionized water, with mixing at about 200 rpm at a temperature of 65° C. This was followed by high shear emulsification for 10 minutes on a "Silverson" mixer at a mixing speed of about 4,000 to 5,000 rpm. The resulting emulsion was white and had a particle size of 3–10 microns spread, $d_{50}$ 3.2 microns as measured on Malvern Mastersizer X. The emulsion was determined to have a pH of 2.5.

EXAMPLE 9

Preparation of Cationic/cationic Surfactant Emulsion.

surfactant emulsion was prepared with 19.4 g (3.5% active) of STEPANEX VR90, which is dialkyl ammonium methoxy sulfate (90% active in isopropanol) available from Stepan, 20 g of 2.0% REWOQUAT B50 (50% active), which is alkyl dimethyl benzyl ammonium chloride, 50% active available from Witco SA, by predispersing in 460.6 g of deionized water, with mixing at about 200 rpm at a temperature of 65° C. This was followed by high shear emulsification for 10 minutes on a "Silverson" mixer at a mixing speed of about 4,000to 5,000 rpm. The resulting emulsion was white and had a particle size of 3–10 microns spread, $d_{50}$ 3.4 microns as measured on Malvern Mastersizer X. The emulsion was determined to have a pH of 2.5.

EXAMPLE 10

Preparation of Fabric Softening Composition Containing Thickener.

Polymeric Rheology Modifier II, prepared in Example 2, was mixed with the cationic surfactant emulsion prepared in Example 7 to form a 1.5% (0.3% active) thickened fabric softening composition. The pH of the fabric softening composition was adjusted to 2.5 with 1M sulfuric acid. The viscosity was determined to be 50 centipoise (cP) immediately and 85 cP after 30 minutes, as measured using a Brookfield ERV8 viscometer, spindle #2, 50 rpm at 20° C.

EXAMPLE 11

Preparation of Fabric Softening Composition Containing Thickener.

Polymeric Rheology Modifier IV was mixed with the cationic/nonionic blend surfactant emulsion prepared in Example 8 to form a 7.5% (1.5% active) thickened fabric softening composition. The pH of the fabric softening composition was adjusted to 2.5 with 1M sulfuric acid. The viscosity was determined to be 739 cP immediately and >1400 cP after 30 minutes, as measured using a Brookfield ERV8 viscometer, spindle #2, 50 rpm at 20° C.

EXAMPLE 12

Preparation of Fabric Softening Composition Containing Thickener.

Polymeric Rheology Modifier II was mixed with the cationic/cationic blend surfactant emulsion prepared in Example 9 to form a 7.5% (1.5% active) thickened fabric softening composition. The pH of the fabric softening composition was adjusted to 2.5 with 1M sulfuric acid. The viscosity was determined to be 355 cP immediately and 418 cP after 30 minutes, as measured using a Brookfield ERV8 viscometer, spindle #2, 50 rpm at 20° C.

EXAMPLE 13

Preparation of Fabric Softening Composition Containing Thickener.

Polymeric Rheology Modifier V was mixed with the cationic/nonionic blend surfactant emulsion prepared in Example 8 to form a 7.5% (1.5% active) thickened fabric softening composition. The pH of the fabric softening composition was adjusted to 2.5 with 1M sulfuric acid. The viscosity was determined to be 406 cP immediately and 550 cP after 30 minutes, as measured using a Brookfield ERV8 viscometer, spindle #2, 50 rpm at 20° C.

EXAMPLE 14

Polymeric Rheology Modifiers I, II, and III, 2.0 g of (wet) Thickener, were individually added to a cationic surfactant emulsion prepared in Example 7, 130 g, (active thickener 0.3%). The pH of each sample was adjusted to 2.5 with 1M sulfuric acid. The thickened fabric softener compositions were blended using low shear mixing for 30 minutes. A control was also prepared without any polymeric rheology modifier.

All viscosity values are reported in units of centipoise (cP). Viscosity was measured after 30 minutes using a Brookfield ERV8 machine, spindle 2, 50 rpm 20° C., and again after the stated time period. The test results are summarized in Table I.

TABLE I

| Polymeric Rheology Modifier (PRM) | 30 Minutes (cP) | 24 Hours (cP) | 10 Days (cP) |
|---|---|---|---|
| None | 15 | 15 | 15 |
| PRM I | 68 | 123 | 162 |
| PRM II | 50 | 85 | 117 |
| PRM III | 80 | 244 | 320 |

The results in Table I clearly show that the viscosity of the thickened fabric softener compositions is much greater as compared to a fabric softener composition without the polymeric rheology modifiers of the invention. The results in Table I also show that the viscosity of the thickened fabric softener compositions increases over time as compared to a fabric softener composition without the polymeric rheology modifiers of the invention which shows no increase in viscosity over time.

The thickened fabric softener compositions of the invention reduce the drying time of fabrics and extend the life of fabrics by reducing interfiber friction and mechanically induced fiber damage during the tumble-drying process. In addition, the thickened fabric softener compositions do not affect rewettability, nor do they build up on cloth in multi-cycle washing as compared to a fabric softener composition without a polymeric rheology modifier. Furthermore, the thickened fabric softener compositions provide softening and reduce the formation of wrinkles equivalent to fabric softener compositions which were not thickened according to the invention.

While the invention has been described with particular reference to certain embodiments thereof, it will be understood that changes and modifications may be made by those of ordinary skill within the scope and spirit of the following claims.

What is claimed is:

1. A thickened aqueous fabric softener composition comprising at least one cationic surfactant and a polymeric rheology modifier, wherein said polymeric rheology modifier is the polymerization product of (i) 5 to 80 weight percent of an alkyl ester of acrylic acid or an alkyl ester of methacrylic acid, wherein the alkyl group has 1 to 18 carbon atoms;

(ii) 5 to 80 weight percent of a monomer selected from the group consisting of a mono- or di-alkylamino alkyl (meth)acrylate, wherein the alkyl group has 1 to 4 carbon atoms; and (iii) 0.01 to 30 weight percent of an associative monomer selected from the group consisting of (b) an ethylenically unsaturated copolymerizable surfactant monomer obtained by condensing a noniomc surfactant with an ethylenically unsaturated carboxylic acid or the anhydride thereof;

wherein the weight percent of monomers is based on 100 weight percent.

2. A thickened aqueous fabric softener composition comprising at least one cationic surfactant and a polymeric rheology modifier, wherein said polymeric rheology modifier is the polymerization product of (i) 5 to 80 weight percent of an alkyl ester of acrylic acid or an alkyl ester of methacrylic acid, wherein the alkyl group has 1 to 18 carbon atoms;

(ii) 5 to 80 weight percent of a monomer selected from the group consisting of a mono- or di-alkylamino alkyl (meth)acrylate, wherein the alkyl group has 1 to 4 carbon atoms; and 0.01 to 30 weight percent of an associative monomer selected from the group consisting of (b) an ethylenically unsaturated copolymerizable surfactant monomer obtained by condensing a nonionic surfactant with an ethylenically unsaturated carboxylic acid or the anhydride thereof; and (iv) 0.01 to 1 weight percent of a cross-linking monomer having at least two ethylenically unsaturated moieties, wherein the weight percent of monomers is based on 100 weight percent.

3. The thickened fabric softener composition according to claim 1 wherein monomer (ii) of the polymeric rheology modifier is selected from the group consisting of N,N-dimethylamino ethyl methacrylate, N,N-diethylamino ethyl acrylate, N,N-diethylamino ethyl methacrylate, N-t-butylamino ethyl acrylate, N-t-butylamino ethyl methacrylate, N,N-dimethylamino propyl acrylamide, N,N-dimethylamino propyl methacrylamide, N,N-diethylamino propyl acrylamide and N,N-diethylamino propyl methacrylamide.

4. The thickened fabric softener composition according to claim 1 wherein said polymeric rheology modifier is prepared with from 0.1 to 10 weight percent of said associative monomer (iii).

5. The thickened fabric softener composition according to claim 2 wherein said polymeric rheology modifier is prepared with from 0.1 to 0.5 weight percent of said crosslinking monomer (iv).

6. The thickened fabric softener composition according to claim 1 wherein the polymeric rheology modifier is present in an amount of from 0.01 to 40 weight percent, based on the total weight of the fabric softener composition.

7. The thickened fabric softener composition according to claim 6 wherein the polymeric rheology modifier is present in an amount of from 0.1 to 25 weight percent.

8. The thickened fabric softener composition according to claim 7 wherein the polymeric rheology modifier is present in an amount of from 0.5 to 10 weight percent.

9. The thickened fabric softener composition according to claim 1 wherein the surfactant is present in an amount of from 0.1 to 30 weight percent, based on the total weight of the fabric softener.

10. The thickened fabric softener composition according to claim 9 wherein the surfactant is present in an amount of from 0.5 to 10 weight percent, based on the total weight of the fabric softener.

11. The thickened fabric softener composition according to claim 1 wherein the fabric softener composition further comprises at least one surfactant selected from the group consisting of nonionic, anionic, amphoteric, and zwitterionic surfactants.

12. The thickened fabric softener composition according to claim 11 wherein the surfactant comprises a combination of at least one cationic surfactant with at least one nonionic surfactant.

* * * * *